US009257245B2

(12) United States Patent
Sun et al.

(10) Patent No.: US 9,257,245 B2
(45) Date of Patent: Feb. 9, 2016

(54) SWITCH AND FOLDING STRUCTURE THEREOF, AND ELECTRONIC DEVICE USING THE SWITCH

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Zhi-Guo Sun, Shenzhen (CN); Jun-Lin Peng, Shenzhen (CN); Yu-Lun Li, Shenzhen (CN)

(73) Assignees: Fu Tai Hua Industry (Shenzhen) Co., Ltd., Shenzhen (CN); HON HAI PRECISION CO., LTD., New Taipei (TW)

( * ) Notice: Subject to any disclaimer, the term of this patent is extended or adjusted under 35 U.S.C. 154(b) by 0 days.

(21) Appl. No.: 14/464,310

(22) Filed: Aug. 20, 2014

(65) Prior Publication Data

US 2015/0054608 A1 Feb. 26, 2015

(30) Foreign Application Priority Data

Aug. 23, 2013 (CN) ..... 2013 1 0371131

(51) Int. Cl.
*H01H 9/00* (2006.01)
*H01H 15/18* (2006.01)
*H01H 5/02* (2006.01)

(52) U.S. Cl.
CPC ..... *H01H 15/18* (2013.01); *H01H 5/02* (2013.01); *H01H 2215/042* (2013.01); *H01H 2221/014* (2013.01); *H01H 2221/03* (2013.01)

(58) Field of Classification Search
CPC ..... H01H 36/0073
USPC ..... 335/207
See application file for complete search history.

(56) References Cited

U.S. PATENT DOCUMENTS

| | | | | |
|---|---|---|---|---|
| 3,025,372 | A * | 3/1962 | Benjetsky | 335/207 |
| 3,325,756 | A * | 6/1967 | Maxwell | 335/205 |
| 3,407,370 | A * | 10/1968 | Fast et al. | 335/206 |
| 3,588,766 | A * | 6/1971 | Baermann | 35/207 |
| 6,243,819 | B1 * | 6/2001 | Jung | 713/320 |
| 6,366,440 | B1 * | 4/2002 | Kung | 361/147 |
| 6,380,921 | B2 * | 4/2002 | Nakamura | 345/102 |
| 6,653,919 | B2 * | 11/2003 | Shih-Chung et al. | 335/207 |
| 6,929,291 | B2 * | 8/2005 | Chen | 292/251.5 |
| 7,548,419 | B1 * | 6/2009 | Lai | 361/679.43 |
| 7,583,500 | B2 * | 9/2009 | Ligtenberg et al. | 361/679.27 |
| 7,775,567 | B2 * | 8/2010 | Ligtenberg et al. | 292/251.5 |
| 7,825,757 | B2 * | 11/2010 | Tang et al. | 335/205 |
| 8,242,867 | B2 * | 8/2012 | Greenway | 335/207 |
| 8,704,622 | B2 * | 4/2014 | Koepsell | 335/207 |

(Continued)

*Primary Examiner* — Alexander Talpalatski
(74) *Attorney, Agent, or Firm* — Novak Druce Connolly Bove + Quigg LLP

(57) ABSTRACT

An electronic device includes a housing, a support member coupled to the housing, a trigger member coupled to the support member, a sliding member, a first magnet member coupled to the sliding member, and a second magnet member coupled to the support member. The first magnet member includes two first magnets and a second magnet coupled to the corresponding first magnet. The magnetic pole of the first magnets is opposite to the magnetic pole of the second magnet. The second magnet member includes a third magnet and two fourth magnets. The magnetic pole of the third magnet is same as the magnetic pole of the second magnet. The magnetic pole of the fourth magnets is same as the magnetic pole of the first magnets.

18 Claims, 7 Drawing Sheets

(56) References Cited

U.S. PATENT DOCUMENTS 8,705,229 B2 * 4/2014 Ashcraft et al. ..... 361/679.27
8,729,987 B2 * 5/2014 Chen et al. ..... 335/205
8,801,054 B2 * 8/2014 Ligtenberg et al. ..... 292/251.5
2008/0061565 A1 * 3/2008 Lee et al. ..... 292/251.5
2008/0278269 A1 * 11/2008 Ramirez et al. ..... 335/205
2009/0278639 A1 * 11/2009 Chao ..... 335/207

* cited by examiner

SWITCH AND FOLDING STRUCTURE THEREOF, AND ELECTRONIC DEVICE USING THE SWITCH

FIELD

The subject matter herein generally relates to switches, and particular to a slide switch including a folding structure and an electronic device using the slide switch.

BACKGROUND

A switch can be coupled to an electronic device, to control an electrical power, for example. However, switches having complex structures may not be suitable for thinner electronic devices.

BRIEF DESCRIPTION OF THE DRAWINGS

Implementations of the present technology will now be described, by way of example only, with reference to the attached figures.

DETAILED DESCRIPTION

Figure 1:
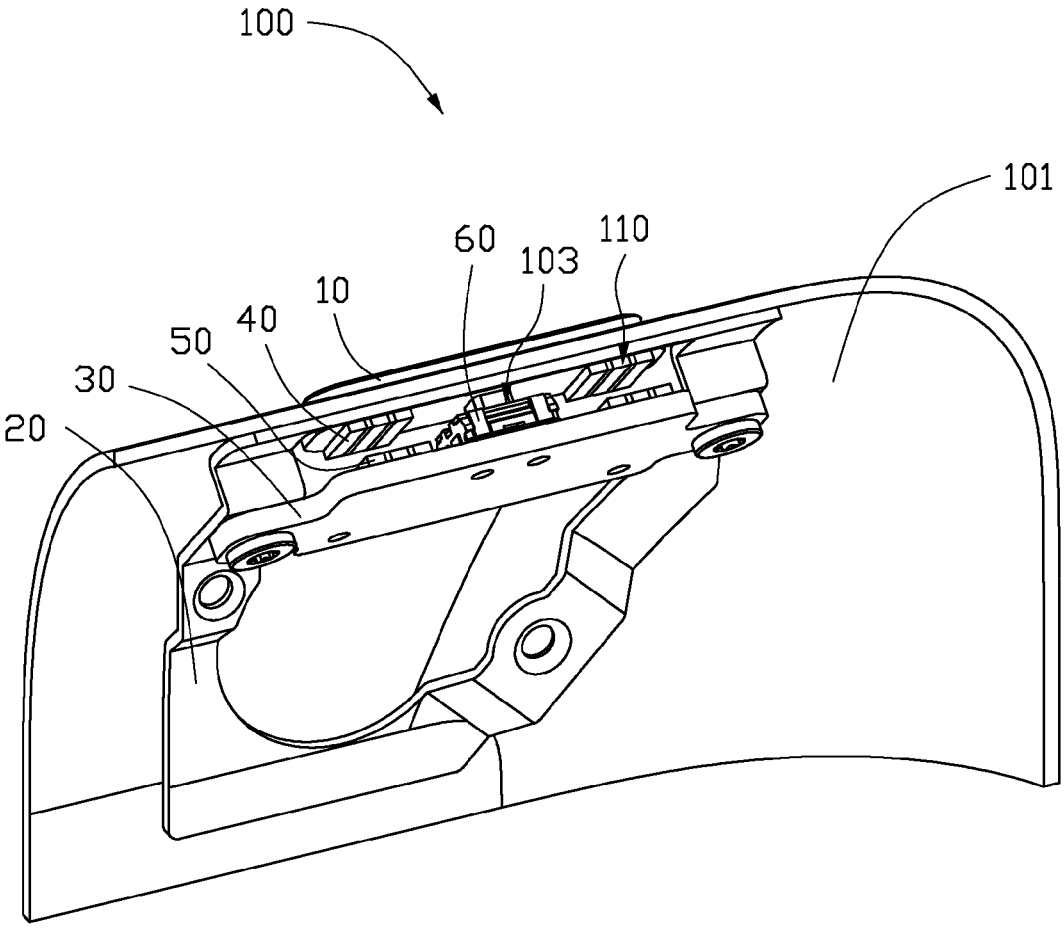
FIG. 1 is a partial, isometric view of a first embodiment of an electronic device including a switch, the switch including a first magnet member and a second magnet member.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is in relation to an electronic device which can include a housing, a support member coupled to the housing, a trigger member coupled to the support member, a sliding member, a first magnet member coupled to the sliding member, and a second magnet member coupled to the support member and corresponding to the first magnet member. The housing can define a receiving hole. The trigger member can include a trigger portion. The sliding member can be slidably received in the receiving hole and positioned reciprocally with the trigger portion. The first magnet member can include at least two first magnets, at least one second magnet, and at least one first magnetic conductive block. The at least two first magnets can be coupled to each other via the at least one first magnetic conductive block. The at least one second magnet can be coupled to the corresponding first magnet. The magnetic pole of the at least two first magnets can be opposite to the magnetic pole of the at least one second magnet.

The second magnet member can be coupled to the support member and corresponding to the first magnet member. The second magnet member can include at least one third magnet, at least two fourth magnets, and at least one second magnetic conductive block. The magnetic pole of the at least one third magnet can be same as the magnetic pole of the at least one second magnet. The magnetic pole of the at least two fourth magnets can be same as the magnetic pole of the at least two first magnets. The at least two fourth magnets can be coupled to each other via the at least one second magnetic conductive block. The at least one third magnet can be coupled to the corresponding fourth magnet and positioned at a side of the at least two fourth magnets away from the second magnet.

FIG. 1 illustrates a first embodiment of an electronic device 100 including a housing 101 and a switch 103 coupled to the housing 101. The housing 101 can define a receiving hole 102 (shown in FIG. 2). The receiving hole 102 can be a through hole in a shape of stripe. In at least one embodiment, the switch 103 can be a power switch. The housing 101 can be an outer housing. The electronic device 100 can be a mobile phone, a tablet computer, for example. The electronic device 100 can include a plurality of function modules, such as a touch screen. In the sake of simplify the specification, introductions for the function modules are omitted.

The switch 103 can include a folding structure 110 and a trigger member 60 coupled to the folding structure 110. The folding structure 110 can include a sliding member 10, a fixing bracket 20, a support member 30, two first magnet members 40, and two second magnet members 50.

Figure 2:
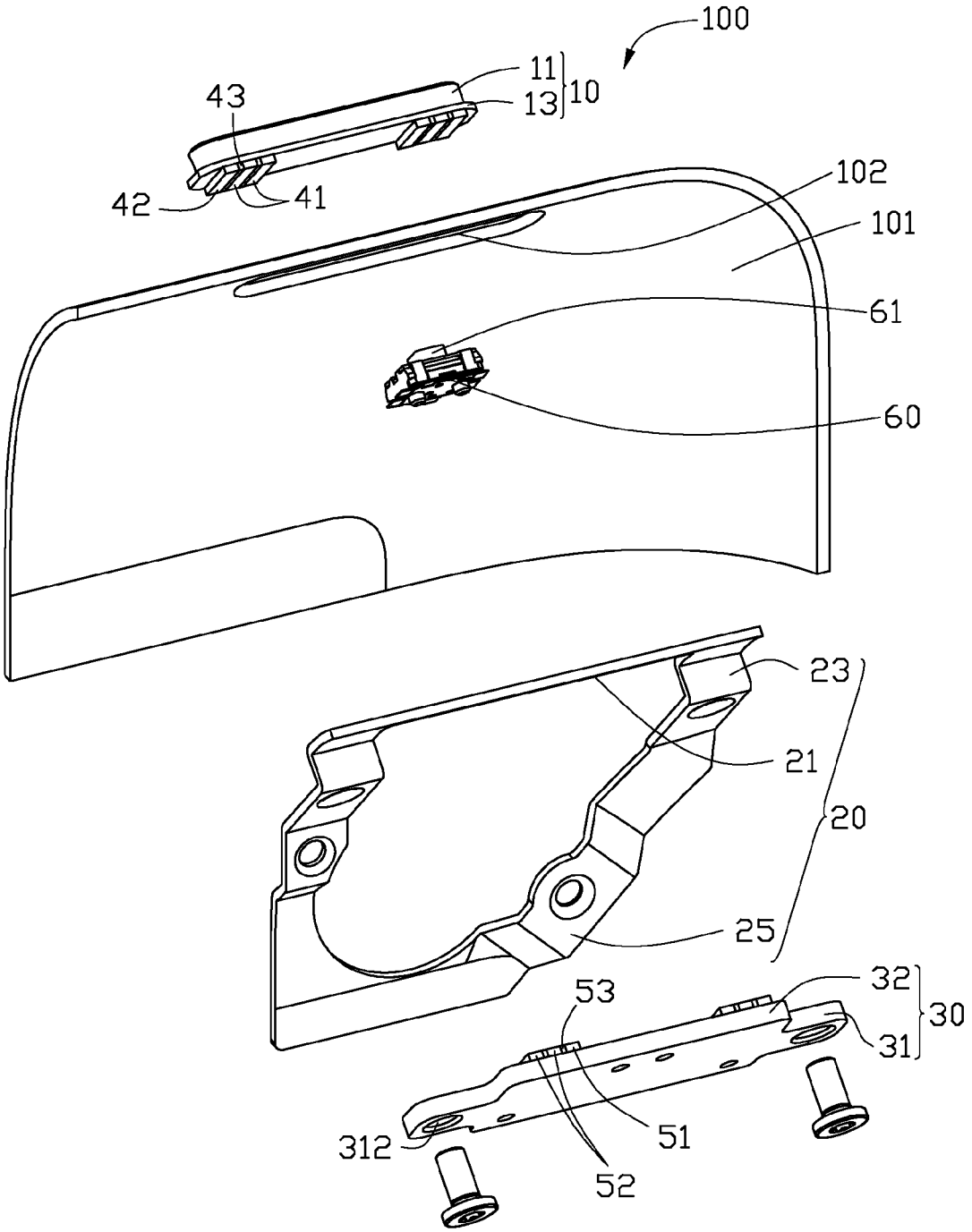
FIG. 2 is an exploded, isometric view of the electronic device in FIG. 1.

FIG. 2 illustrates that the sliding member 10 can be received in the receiving hole 102 of the housing 101 and configured to slide along a longitudinal direction of the receiving hole 102. The fixing bracket 20 can be coupled to an inner side surface of the housing 101. The support member 30 can be coupled to the fixing bracket 20 and positioned opposite to the receiving hole 102. The first magnet members 40 can be coupled to the sliding member 10. The second magnet members 50 can be coupled to the support member 30 and positioned opposite to the first magnet members 40.

The sliding member 10 can include a main body 11 and a limiting portion 13 coupled to the main body 11. The main body 11 can be in a shape of a stripe. A length of the main body 11 can be less than that of the receiving hole 102. Thus, the main body 11 can be configured to slide along the longitudinal direction of the receiving hole 102. The limiting portion 13 can extend outward from an edge of the main body 11. A size of the limiting portion 13 can be larger than that of the receiving hole 102. The limiting portion 13 can be positioned at an inner side of the housing 101 and latched with the housing 101 to prevent the sliding member 10 from getting out of the receiving hole 102.

The fixing bracket 20 includes a first fixing portion 21, two second fixing portions 23, and a third fixing portion 25. The first fixing portion 21 can be substantially rectangular and coupled to the inner side of the housing 101. The second fixing portions 23 can extend from opposite ends of the first fixing portion 21 and coupled to opposite ends of the third fixing portion 25. The first fixing portion 21, the second fixing portions 23, and the third fixing portion 25 can cooperatively form a substantially closed bracket. In at least one embodiment, the first fixing portion 21 can be coupled to the inner side surface of the housing 101 by welding. The third fixing portion 25 can be configured to couple other components (not shown) of the electronic device 100.

The support member 30 can include a support portion 32 and a pair of extending portions 31 respectively extending from opposite ends of the support portion 32. Each extending portion 31 can define a through hole 312. The extending portions 31 can be coupled to the second fixing portion 23 of the fixing bracket 20 via fasteners (not labeled) received in the through holes 312.

Figure 3:
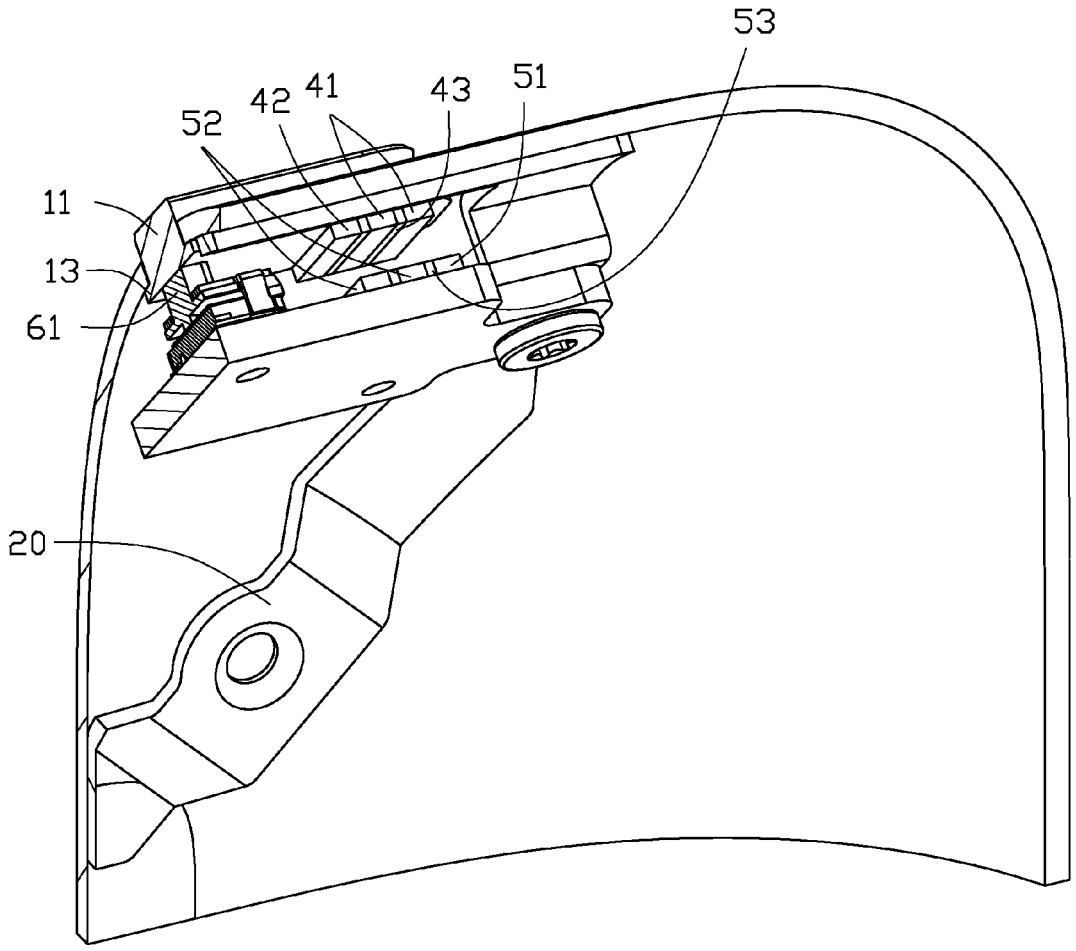
FIG. 3 is a cross sectional view of the electronic device in FIG. 1.

FIG. 3 illustrates that the first magnet members 40 can be coupled to a surface of the limiting member 13 adjacent to the support member 30 and arranged apart. Each first magnet member 40 can include at least two first magnets 41, at least one second magnet 42, and at least one first magnetic conductive block 43. One of the at least one first magnetic conductive block 43 can be positioned between two adjacent first magnets 41. That is, the at least two first magnets 41 can be coupled to each other via the at least one first magnetic conductive block 43. The at least one second magnet 42 can be positioned at a side of the at least two first magnets 41. The at least one second magnet 42 can be directly coupled to the adjacent first magnet 41 or coupled to the adjacent first magnet 41 via another one of the at least one first magnetic conductive block 43 positioned therebetween. The magnetic pole of the first magnets 41 can be opposite to the magnetic pole of the second magnet 42.

The first magnetic conductive block 43 can be magnetized by the first magnets 41 or the second magnet 42. Thus, the first magnetic conductive block 43 can couple the adjacent first magnets 41 or couple the second magnet 42 with the adjacent first magnet 41. The at least two the first magnets 41, the at least one second magnet 42, and the at least one first magnetic conductive block 43 can be arranged parallel to each other. In at least one embodiment, a number of the at least two first magnets 41 can be two. A number of the at least one second magnet 42 can be one. A number of the at least one first magnetic conductive block 43 can be two. The two first magnetic conductive blocks 43 can be made of iron. One of the first magnetic conductive blocks 43 can be sandwiched between the two first magnets 41. Another one of the first magnetic conductive blocks 43 can be sandwiched between the second magnet 42 and the adjacent first magnet 41.

The second magnet members 50 can be coupled to a surface of the support portion 32 adjacent to the sliding member 10 and arranged apart (shown in FIG. 3). Each second magnet member 50 can face to the corresponding first magnet member 40. Each second magnet member 50 can include at least one third magnet 51, at least two fourth magnets 52, and at least one second magnetic conductive block 53. The magnetic pole of the third magnet 51 can be same as the magnetic pole of the second magnet 42. The magnetic pole of the fourth magnets 52 can be same as the magnetic pole of the first magnets 41. One of the at least one second magnetic conductive block 53 can be positioned between two adjacent fourth magnets 52. That is, the at least two fourth magnets 52 can be coupled to each other via the at least one second magnetic conductive block 53. The at least one third magnet 51 can be positioned at a side of the at least two fourth magnets 52 away from the second magnet 42. The at least one third magnet 51 can be directly coupled to the adjacent fourth magnet 52 or coupled to the adjacent first magnet 52 via another one of the at least one second magnetic conductive block 53 positioned therebetween.

The second magnetic conductive block 53 can be magnetized by the third magnet 51 or the fourth magnets 52. Thus, the second magnetic conductive block 53 can couple the adjacent fourth magnet 52 or couple the third magnet 51 with the adjacent fourth magnet 52. The at least two the fourth magnets 52, the at least one third magnet 51, and the at least one second magnetic conductive block 53 can be arranged parallel to each other. In at least one embodiment, a number of the at least one third magnets 51 can be one. A number of the at least two fourth magnets 52 can be two. A number of the at least one second magnetic conductive block 53 can be two. The two second magnetic conductive blocks 53 can be made of iron. One of the second magnetic conductive blocks 53 can be sandwiched between the two fourth magnets 52. Another one of the second magnetic conductive blocks 53 can be sandwiched between the third magnet 51 and the adjacent fourth magnet 52.

The trigger member 60 can be coupled to the support portion 32 and positioned between the second magnet members 50. The second magnet members 50 can be symmetric relative to the trigger member 60. The trigger member 60 can include a trigger portion 61 positioned corresponding to the sliding member 10. The limiting portion 13 of the sliding member 10 can be configured to resist against the trigger portion 61 to turn on the switch 103. In at least one embodiment, the trigger member 60 can be coupled to the support member 30 by welding.

Figure 4:
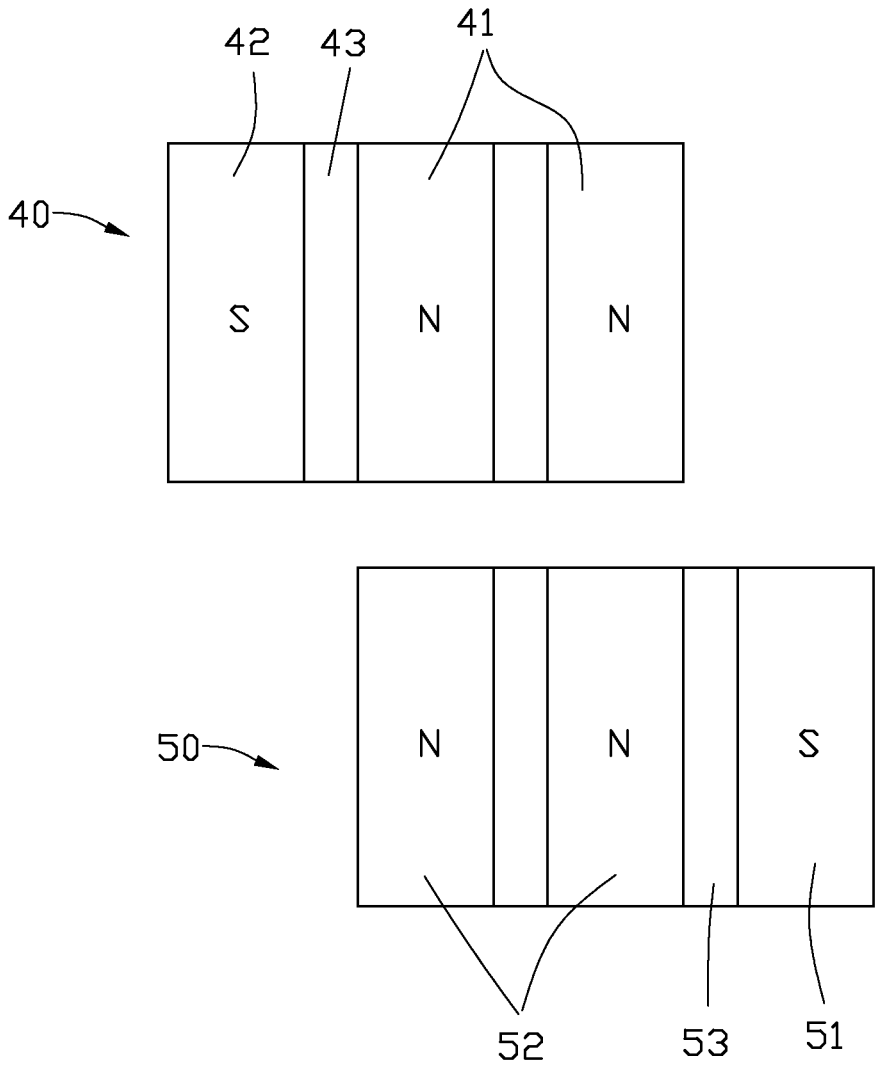
FIG. 4 is a diagrammatic view of the first magnet member and the second magnet member of the electronic device in FIG. 1.

FIG. 4 illustrates that a magnetic pole of the second magnet 42 can be S-pole. A magnetic pole of the third magnet 51 can be S-pole. A magnetic pole of the first magnets 41 can be S-pole. A magnetic pole of the fourth magnets 52 can be N-pole. When the switch 103 is not triggered, the first magnets 41 can be respectively face to the corresponding fourth magnets 52. Thus, each first magnet member 40 and the corresponding second magnet member 50 can repel each other.

In assembly the electronic device 100, the first magnet members 40 can be coupled to the sliding member 10. The second magnet members 50 can the trigger member 60 can be coupled to the support member 30. The main body 11 of the sliding member 10 can be received in the receiving hole 102 of the housing 100. The extending portions 31 of the support member 30 can be coupled to the second fixing portions 23 of the fixing bracket 20.

When the switch 103 is not triggered, each first magnet member 40 and the corresponding second magnet member 50 can repel each other. The second magnet 42 and the fourth magnets 52 can opposite attract. The first magnets 41 and the third magnet 51 can opposite attract. Thus, a moving tendency between the first magnet members 40 can the second magnet members 50 can be produced. However, a frictional force between the sliding member 10 and the housing 101 can stop the moving tendency. Thus, the sliding member 10 can remain stable when the switch is not triggered.

Figure 5:
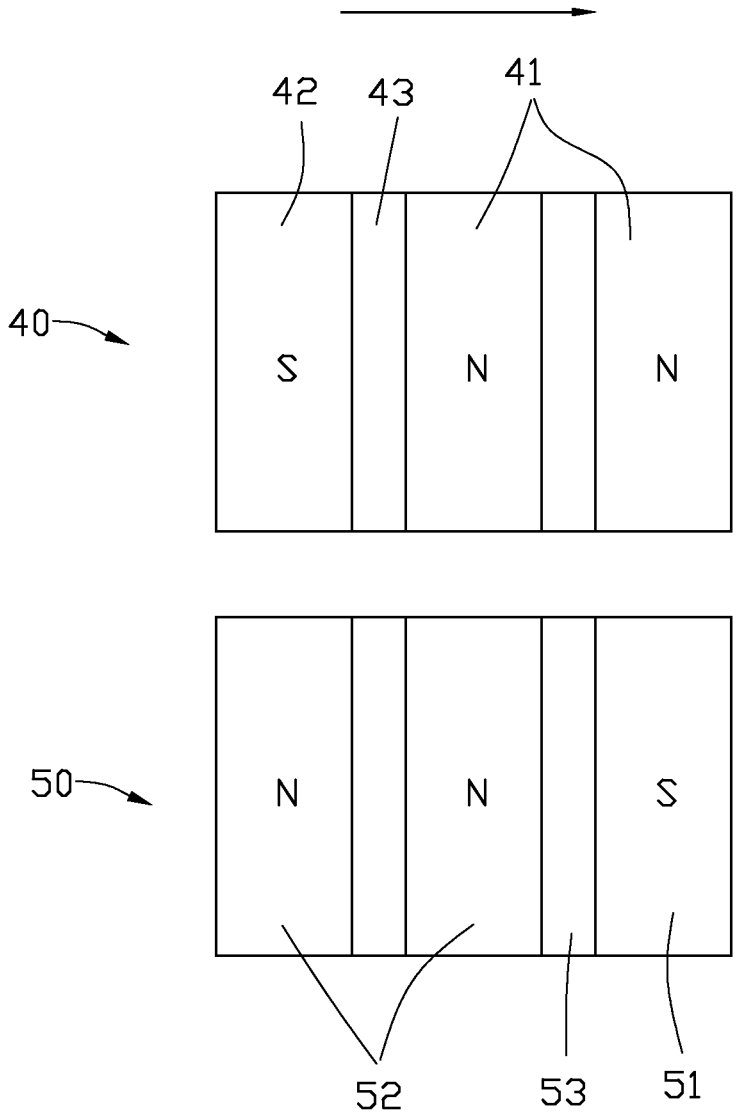
FIG. 5 is a diagrammatic view of the first magnet member and the second magnet member of the electronic device in FIG. 1 in a state of use.

When the switch to be triggered, the main body 11 of the sliding member 10 is pushed to move along the longitudinal direction of the receiving hole 102. FIG. 5 illustrates that the first magnet members 40 can move relative to the second magnet members 50 until the third magnet 51 faces the first magnet 41 away from the second magnet 41 and the second magnet 42 faces the fourth magnet 52 away from the third magnet 51. Thus, each first magnet member 40 can attract the corresponding second magnet member 50 to make the sliding member 10 to move towards the support member 30 and resist against the trigger portion 61. Thus, the switch 103 can be triggered.

When the sliding member 10 is pushed in opposite direction, the first magnets 41 can face the fourth magnets 52 again. The first magnet members 40 and the second magnet members 50 can repel again. Thus, the sliding member 10 can move away from the support member 30 to stop resisting against the trigger portion 61.

Figure 6:
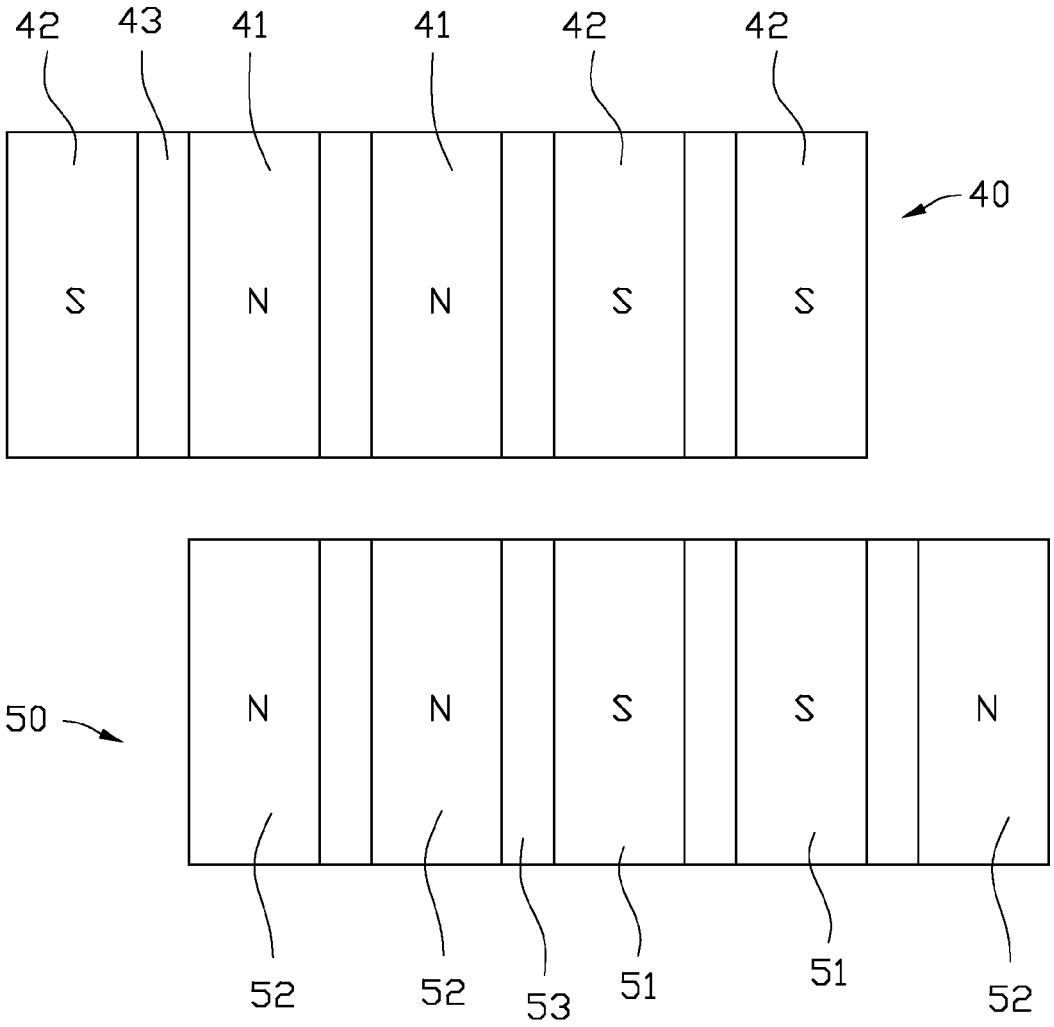
FIG. 6 is a partial, diagrammatic view of a second embodiment of a switch.
Figure 7:
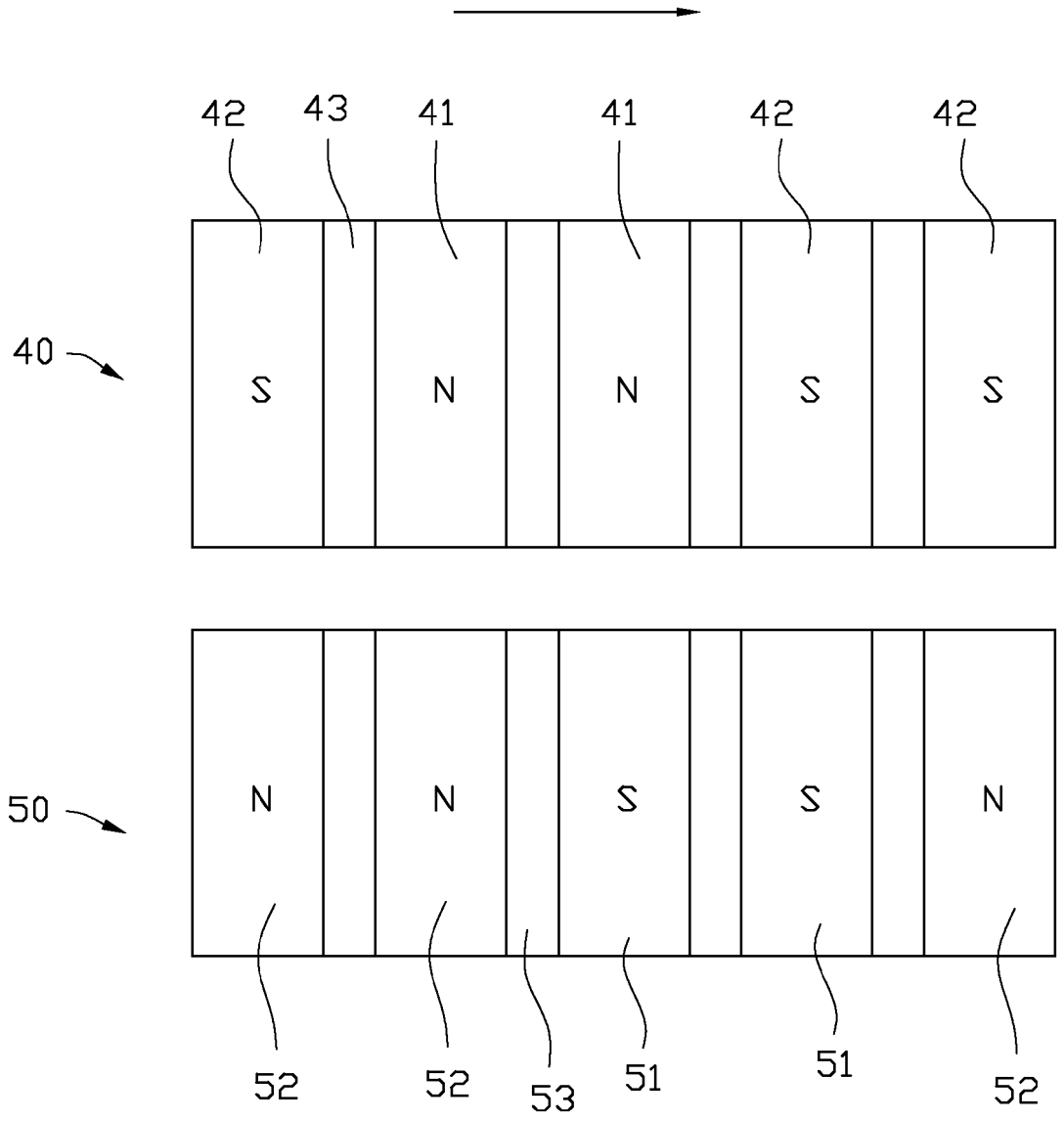
FIG. 7 is a partial, diagrammatic view of the switch in FIG. 6 in a state of use.

FIG. 6 illustrates a second embodiment of an electronic device (not shown) similar to the electronic device 100. Differences between the electronic device of the second embodiment and the electronic device 100 are illustrated below. A number of the first magnet 41 of each first magnet member 40 can be two. A number of the second magnet 42 can be three. Two second magnets 42 can be positioned at a side of the first magnets 41 and another one second magnets 42 can be positioned at an opposite side of the first magnets 41. A number of the first magnetic conductive block 43 can be four and respectively positioned between adjacent first magnets 41 and second magnets 42. A number of the third magnet 51 of each second magnet member 50 can be two. A number of the fourth magnet 52 can be three. Two fourth magnets 52 can be positioned at a side of the third magnets 51 and another one fourth magnet 52 can be positioned at an opposite side of the third magnets 51. A number of the second magnetic conductive block 53 can be four and respectively positioned between adjacent third magnets 51 and fourth magnets 52. When the switch 103 is not triggered, the first magnets 41 can face the two adjacent fourth magnets 52 and two adjacent second magnets 42 can face the third magnets 51 (shown in FIG. 6). FIG. 7 illustrates that when the sliding member 10 is pushed, an attract force between the first magnet member 40 and the second magnet member 50 can be larger than a repel force between the first magnet member 40 and the second magnet member 50. Thus, the first magnet member 40 can attract the second magnet member 50.

In at least one embodiment, the fixing bracket 20 can be omitted and then the support member 30 can be directly coupled to the housing 101.

In at least one embodiment, when the switch 103 is not triggered, an attract force between the first magnet members 40 and the second magnet members 50 can be less than a repel force between the first magnet members 40 and the second magnet members 50. When the switch 103 is triggered, an attract force between the first magnet members 40 and the second magnet members 50 can be larger than a repel force between the first magnet members 40 and the second magnet members 50.

The embodiments shown and described above are only examples. Many details are often found in the art such as the other features of a switch. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A switch comprising:

a support member;

a trigger member coupled to the support member and comprising a trigger portion;

a sliding member positioned reciprocally with the trigger portion;

a first magnet member coupled to the sliding member, the first magnet member comprising at least two first magnets, at least one second magnet, and at least one first magnetic conductive block, the at least two first magnets coupled to each other via the at least one first magnetic conductive block, the at least one second magnet coupled to the corresponding first magnet, the magnetic pole of the at least two first magnets opposite to the magnetic pole of the at least one second magnet;

a second magnet member coupled to the support member and corresponding to the first magnet member, the second magnet member comprising at least one third magnet, at least two fourth magnets, and at least one second magnetic conductive block, the magnetic pole of the at least one third magnet same as the magnetic pole of the at least one second magnet, the magnetic pole of the at least two fourth magnets same as the magnetic pole of the at least two first magnets, the at least two fourth magnets coupled to each other via the at least one second magnetic conductive block, the at least one third magnet coupled to the corresponding fourth magnet and positioned at a side of the at least two fourth magnets away from the second magnet, wherein, the sliding member is configured to slide to trigger the switch, when the switch is not triggered, an attract force between the first magnet member and the second magnet member is less than a repel force between the first magnet member and the second magnet member, when the switch is triggered, an attract force between the first magnet member and the second magnet member is larger than a repel force between the first magnet member and the second magnet member.

2. The switch of claim 1, wherein the sliding member comprises:

a main body, and a limiting portion extending outward from an edge of the main body, the first magnet member is coupled to a surface of the limiting member adjacent to the support member.

3. The switch of claim 1 further comprising a fixing bracket, wherein the fixing bracket is coupled to the support member.

4. The switch of claim 3, wherein the support member comprises:

a support portion, wherein, the trigger member and the second magnet member are coupled to the support portion, and a pair of extending portions respectively extending from opposite ends of the support portion and coupled to the fixing bracket.

5. The switch of claim 1, wherein a number of the at least two first magnets is two, a number of the at least one second magnet is one, a number of the at least one first magnetic conductive block is two, the first magnets are coupled to each other via one of the first magnetic conductive blocks, the second magnet is coupled to one of the first magnets via another one of the first magnetic conductive blocks.

6. The switch of claim 5, wherein a number of the at least two fourth magnets is two, a number of the at least one third magnet is one, a number of the at least one second magnetic conductive block is two, the fourth magnets are coupled to each other via one of the second magnetic conductive blocks, the third magnet is coupled to one of the fourth magnets via another one of the second magnetic conductive blocks.

7. The switch of claim 6, wherein the first magnets respectively face to the corresponding fourth magnets.

8. The switch of claim 1, wherein a number of the first magnet is two, a number of the second magnet is three, two of the second magnets are positioned at a side of the first magnets and another one of the second magnets is positioned at an opposite side of the first magnets, a number of the first magnetic conductive block is four and respectively positioned between the adjacent first magnets and second magnets, a number of the third magnet is two, a number of the fourth magnet is three, two of the fourth magnets are positioned at a side of the third magnets and another one of the fourth magnets is positioned at an opposite side of the third magnets, a number of the second magnetic conductive block is four and respectively positioned between adjacent third magnets and fourth magnets.

9. An electronic device comprising:

a housing defining a receiving hole; and a switch comprising:

a support member coupled to the housing, a trigger member coupled to the support member and comprising a trigger portion, a sliding member slidably received in the receiving hole and positioned corresponding to the trigger portion, a first magnet member coupled to the sliding member, the first magnet member comprising at least two first magnets, at least one second magnet, and at least one first magnetic conductive block, the at least two first magnets coupled to each other via the at least one first magnetic conductive block, the at least one second magnet coupled to the corresponding first magnet, the magnetic pole of the at least two first magnets opposite to the magnetic pole of the at least one second magnet, and a second magnet member coupled to the support member and corresponding to the first magnet member, the second magnet member comprising at least one third magnet, at least two fourth magnets, and at least one second magnetic conductive block, the magnetic pole of the at least one third magnet same as the magnetic pole of the at least one second magnet, the magnetic pole of the at least two fourth magnets same as the magnetic pole of the at least two first magnets, the at least two fourth magnets coupled to each other via the at least one second magnetic conductive block, the at least one third magnet coupled to the corresponding fourth magnet and positioned at a side of the at least two fourth magnets away from the second magnet, wherein, the sliding member is configured to slide to trigger the switch, when the switch is not triggered, an attract force between the first magnet members and the second magnet members is less than a repel force between the first magnet members and the second magnet members, when the switch is triggered, an attract force between the first magnet members and the second magnet members is larger than a repel force between the first magnet members and the second magnet members.

10. The electronic device of claim 9, wherein the sliding member comprises:

a main body received in the receiving hole, and a limiting portion extending outward from an edge of the main body, the limiting portion is positioned at an inner side of the housing and latched with the housing to prevent the sliding member from getting out of the receiving hole, the first magnet member is coupled to a surface of the limiting member adjacent to the support member.

11. The electronic device of claim 9 further comprising a fixing bracket, wherein the fixing bracket is coupled to the support member.

12. The electronic device of claim 11, wherein the support member comprises:

a support portion, wherein, the trigger member and the second magnet member are coupled to the support portion, and a pair of extending portions respectively extending from opposite ends of the support portion and coupled to the fixing bracket.

13. The electronic device of claim 9, wherein a number of the at least two first magnets is two, a number of the at least one second magnet is one, a number of the at least one first magnetic conductive block is two, the first magnets are coupled to each other via one of the first magnetic conductive blocks, the second magnet is coupled to one of the first magnets via another one of the first magnetic conductive blocks.

14. The electronic device of claim 13, wherein a number of the at least two fourth magnets is two, a number of the at least one third magnet is one, a number of the at least one second magnetic conductive block is two, the fourth magnets are coupled to each other via one of the second magnetic conductive blocks, the third magnet is coupled to one of the fourth magnets via another one of the second magnetic conductive blocks.

15. The electronic device of claim 14, wherein the first magnets respectively face to the corresponding fourth magnets.

16. The electronic device of claim 9, wherein a number of the first magnet is two, a number of the second magnet is three, two of the second magnets are positioned at a side of the first magnets and another one of the second magnets is positioned at an opposite side of the first magnets, a number of the first magnetic conductive block is four and respectively positioned between adjacent first magnets and second magnets, a number of the third magnet is two, a number of the fourth magnet is three, two of the fourth magnets are positioned at a side of the third magnets and another one of the fourth magnets is positioned at an opposite side of the third magnets, a number of the second magnetic conductive block is four and respectively positioned between adjacent third magnets and fourth magnets.

17. A folding structure comprising:

a support member;

a sliding member;

a first magnet member coupled to the sliding member, the first magnet member comprising two first magnets, a second magnet, and two first magnetic conductive blocks, the first magnets coupled to each other via one of the first magnetic conductive blocks, the second magnet coupled to the corresponding first magnet via another one of the first magnetic conductive blocks, the magnetic pole of the first magnets opposite to the magnetic pole of the second magnet;

a second magnet member corresponding to the first magnet member, the second magnet member comprising a third magnet, two fourth magnets, and two second magnetic conductive blocks, the magnetic pole of the third magnet same as the magnetic pole of the second magnet, the magnetic pole of the fourth magnets same as the magnetic pole of the first magnets, the fourth magnets coupled to each other via one of the second magnetic conductive blocks, the third magnet coupled to the corresponding fourth magnet via another one of the second magnetic conductive blocks and positioned at a side of the fourth magnets away from the second magnet.

18. The folding structure of claim 17, wherein the first magnets respectively face to the corresponding fourth magnets.

* * * * *